US005873706A

United States Patent [19]

Kawabata

[11] Patent Number: 5,873,706

[45] Date of Patent: Feb. 23, 1999

[54] VALVED SUCTION MECHANISM FOR REFRIGERANT COMPRESSOR

[75] Inventor: Hironari Kawabata, Isesaki, Japan

[73] Assignee: Sanden Corporation, Gunma, Japan

[21] Appl. No.: 761,821

[22] Filed: Dec. 6, 1996

[30] Foreign Application Priority Data

Dec. 13, 1995 [JP] Japan ..... 7-346651

[51] Int. Cl.[6] ..... F04B 49/08

[52] U.S. Cl. ..... 417/295; 417/270; 417/440

[58] Field of Search ..... 417/269, 270, 417/298, 440, 295

[56] References Cited

U.S. PATENT DOCUMENTS

| | | | |
|---|---|---|---|
| 4,011,029 | 3/1977 | Shimizu . | |
| 4,330,999 | 5/1982 | Nakayama . | |
| 4,432,698 | 2/1984 | Shirakuma et al. | 417/27 |
| 4,505,122 | 3/1985 | Inomata . | |
| 4,905,477 | 3/1990 | Takai . | |
| 4,976,284 | 12/1990 | Hovarter . | |
| 5,183,395 | 2/1993 | Langouet | 417/310 |
| 5,242,276 | 9/1993 | Shimizu . | |
| 5,318,410 | 6/1994 | Kawamura et al. | 417/222.2 |
| 5,533,870 | 7/1996 | Takenaka et al. | 417/269 |
| 5,611,675 | 3/1997 | Uchida et al. | 417/270 |
| 5,674,054 | 10/1997 | Ota et al. | 417/269 |
| 5,688,111 | 11/1997 | Takai | 417/289 |

FOREIGN PATENT DOCUMENTS

| | | |
|---|---|---|
| 0704622 | 4/1996 | European Pat. Off. . |
| 2357578 | 5/1975 | Germany . |
| 3345267 | 6/1984 | Germany . |
| 3329790 | 2/1985 | Germany . |

OTHER PUBLICATIONS

European Search Report completed Feb. 2, 1998.

*Primary Examiner*—Charles G. Freay
*Assistant Examiner*—Ehud Gartenberg
*Attorney, Agent, or Firm*—Baker & Botts, L.L.P.

[57] ABSTRACT

A refrigerant compressor includes a compressor housing divided by a valve plate into a first chamber and a second chamber. The valve plate includes suction conduits linking the first chamber with the suction chamber and discharge conduits linking the first chamber with the discharge chamber. A suction valve member bends to open and close the suction conduits in response to changes in discharge chamber pressure and the resulting pressure difference between the first chamber and the suction chamber. A suction valve control mechanism includes a regulator for regulating the opening and closing of the suction conduit between a maximum opening position and a minimum opening position in response to changes in discharge chamber pressure. Consquently, a starting torque shock to the compressor is reduced while maintaining high volumetric efficiency of the compressor.

2 Claims, 3 Drawing Sheets

VALVED SUCTION MECHANISM FOR REFRIGERANT COMPRESSOR

BACKGROUND OF THE INVENTION

1. Field of the Invention

The invention relates to a fluid displacement apparatus with a suction valve mechanism and, more particularly, to a valved suction mechanism of a piston-type refrigerant compressor used in an automotive air conditioning system.

2. Description of the Related Art

Piston-type compressors, such as a swash plate-type compressor and a wobble plate-type compressor, are known in the art. For example, U.S. Pat. No. 4,976,284 to Hovarter describes an air conditioning device used for a vehicle employing a multi-cylinder, piston-type compressor with reciprocatory piston, and a suction and discharge valve mechanism. The suction and discharge valve mechanism has a valve plate defining suction and discharge ports and a valve sheet defining resilient reed valves therein. The ends of a cylinder block are closed by front and rear housings, through the valve plate, so that suction and discharge chambers are formed in each of the housings.

The suction chamber is in fluid communication with the compression chambers through a suction valve mechanism having suction ports, which are formed in the valve plate, and suction valves, which are arranged on the inner side of the valve plate. Discharge chambers are in fluid communication with the compression chambers through a discharge valve mechanism. The discharge valve mechanism includes discharge ports, which are formed in the valve plate, and discharge valves, which are arranged on the outer side of the valve plate. The housing is provided with inlet ports, which permit refrigerant gas to be introduced from the eternal portions of the air conditioning circuit and to flow into the suction chambers, and outlet ports, which permit a compressed refrigerant gas to flow from the discharge chambers into the air conditioning circuit. A free end of each suction valve is resiliently bent and moves away from the valve plate due to the differential between pressure within the compression chambers and that within the suction chamber during the suction stroke of the reciprocating piston in the compression chamber.

When the discharge stroke ends and the subsequent suction stroke begins, each suction valve is bent to an open position by the differential between a reduced pressure within the compression chamber and the pressure prevailing in the suction chamber of the housing. The suction port is opened to allow the refrigerant gas in the suction chamber to be drawn into the compression chamber. When the suction stroke ends and the compression stroke begins, each suction valve returns to the closed position, to close the suction port under the high pressure of the compressed refrigerant gas, and the associated discharge valve is moved to the open position, to open the discharge ports by the high pressure of the compression gas.

In the above described construction and operation of a known suction valve mechanism of the reciprocating piston-type compressor, the cross-sectional area of each suction port is designed to be constant. Therefore, starting torque shock may to occur at the time of starting of the compressor because a relatively large amount of refrigerant gas is introduced into the compression chamber and a great deal of power is required to compress the refrigerant gas.

In an attempt to solve this problem, the cross-sectional area of each suction port is designed to be significantly reduced. However, during the operation of the compressor, the discharge ability of the compressor is reduced due to the pressure loss of the refrigerant gas through small suction ports. Therefore, it is difficult to simultaneously resolve each of the above-mentioned problems.

SUMMARY OF THE INVENTION

It is an object of the present invention to provide a refrigerant compressor for use in an automotive air conditioning system, wherein starting torque shock is reduced while maintaining high volumetric efficiency of the compressor.

In an embodiment of the present invention, a refrigerant compressor comprises a compressor housing divided, e.g., at least partially divided, by a valve plate into a first chamber and a second chamber. The second chamber includes a discharge chamber and a suction chamber. The first chamber is linked to the second chamber by linking means including a plurality of suction and discharge conduits. The first chamber is linked to the suction chamber by a plurality of suction conduits. The first chamber is linked to the discharge chamber by a plurality of discharge conduits. A plurality of suction valve members are responsive to a difference in pressure between the first chamber and the suction chamber to bend to open and to close the open end of a corresponding one of the suction conduits. A plurality of discharge valve members are responsive to a difference in pressure between the first chamber and the discharge chamber to bend to open and to close the open end of a corresponding one of the discharge conduits. The compressor further comprises suction conduit regulating means having a regulator for regulating an area of the open end of at least one of the suction conduits in response to a difference in pressure between the suction chamber and the discharge chamber.

In another embodiment of the present invention, a suction valve assembly for use in a compressor comprises a suction chamber and a discharge chamber on one side of a valve plate and a compression chamber on the other side of the valve plate. The assembly further comprises a plurality of suction conduits disposed in the valve plate for placing the compression chamber in communication with the suction chamber and suction conduit regulating means disposed in the suction chamber for regulating an area of an open end of at least one of the suction conduits in response to a difference in pressure between the suction chamber and the discharge chamber.

Further objects, features, and advantages of the present invention will be understood from the detailed description of preferred embodiments of the invention with reference to the annexed drawings.

DETAILED DESCRIPTION OF PREFERRED EMBODIMENTS

Figure 1:
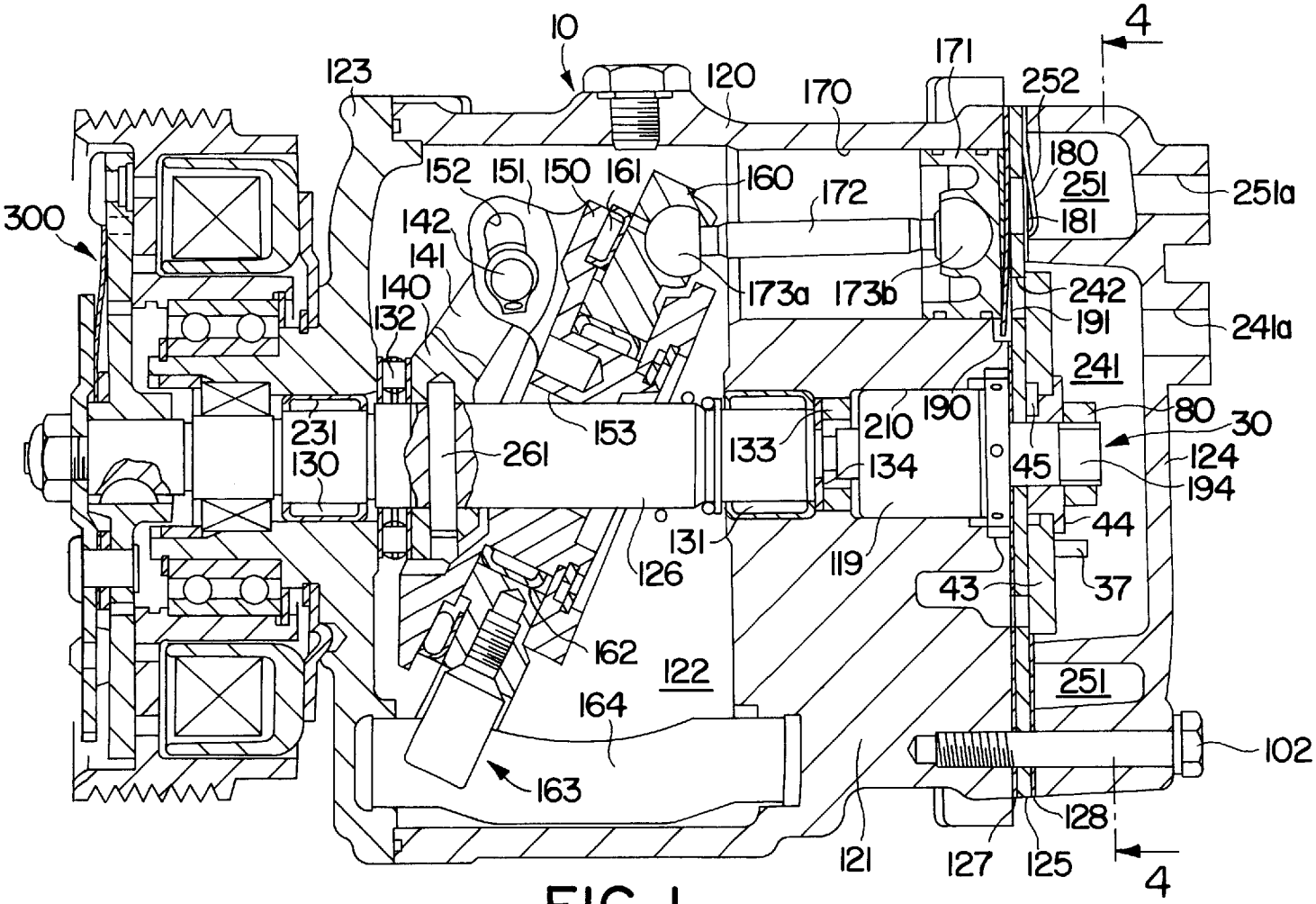
FIG. 1 is a longitudinal cross-sectional view of a slant-plate type refrigerant compressor in accordance with a present invention.

FIG. 1 depicts a fluid displacement apparatus in accordance with the present invention, in particular a slant-plate type compressor, according to one embodiment of the present invention.

A compressor 10 comprises a cylindrical housing assembly 120 including a cylinder block 121, a front end plate 123 at one end of cylinder block 121, and a rear end plate 124 at the other end of cylinder block 121. A crank chamber 122 is formed between cylinder block 121 and front end plate 123, and front end plate 123 is mounted on the front end of cylinder block 121 (toward the left side of FIG. 1) by a plurality of bolts (not shown). Rear end plate 124 is mounted on cylinder block 121 at its rear end (towards the right in FIG. 1) by a plurality of bolts 102. A valve plate 125 is located between rear end plate 124 and cylinder block 121. An opening 231 is centrally formed in front end plate 123 for supporting drive shaft 126 by a first drive shaft bearing 130, which is disposed in opening 231. An inner end portion of drive shaft 126 is rotatably supported by a second drive shaft bearing 131 disposed within a center bore 210 formed in the cylinder block 121. Bore 210 extends rearward toward the end surface of cylinder block 121, wherein a valve control mechanism 119 is disposed.

A cam rotor 140 is attached to drive shaft 126 by a pin member 261 and rotates together with drive shaft 126. A thrust needle bearing 132 is disposed between an inner end surface of front end plate 123 and adjacent axial end surface of cam rotor 140. Cam rotor 140 has an arm 141 with a pin member 142 extending therefrom. A slant plate 150 is adjacent cam rotor 140 and has an opening 153 through which drive shaft 126 passes. Slant plate 150 includes an arm 151 having a slot 152. Cam rotor 140 and slant plate 150 are coupled by pin member 142, which extends through slot 152 to create a hinged joint. Pin member 142 is slidable within slot 152 to allow adjustment of an angular position of a slant plate 150 with respect to a longitudinal axis of drive shaft 126.

A wobble plate 160 is nutatably mounted on slant plate 150 through bearings 161 and 162. A fork-shaped slider 163 is attached to an outer peripheral end wobble plate 160 and slidably mounted on a sliding rail 164, which is held between front end plate 123 and cylinder block 121. Fork-shaped slider 163 prevents rotation of wobble plate 160. Wobble plate 160 nutates along rail 164 as cam rotor 140 rotates with drive shaft 126. Cylinder block 121 includes a plurality of peripherally-located cylinders 170, in which a plurality of corresponding pistons 171 reciprocate. Each piston 171 is connected to wobble plate 160 by a connecting rod 172.

Rear end plate 124 has a centrally-located suction chamber 241 and a peripherally-located annular, discharge chamber 251. Valve plate 125 has a plurality of valved suction conduits 242 linking suction chamber 241 with the respective cylinders 170. Valve plate 125 also has a plurality of valved discharge conduits 252 linking discharge chamber 251 with the respective cylinders 170.

Suction chamber 241 is connected to an evaporator (not shown) of a cooling circuit (not shown) by way of an inlet port 241*a*. Discharge chamber is provided with outlet port 251*a*, which is connected to a condenser (not shown) of the cooling circuit (not shown). First and second gaskets 127 and 128 are located between cylinder block 121 and an inner surface of valve plate 125 and between an outer surface of valve plate 125 and rear end plate 124, respectively, to seal the mating surfaces of cylinder block 121, valve plate 125, and rear end plate 124.

A disc-shaped adjusting screw member 133 is disposed in a central region of bore 210 between bearing 131 and valve control mechanism 119. Disc-shaped adjusting screw member 133 is screwed into bore 210 to be in contact with the inner end surface of drive shaft 126 through a washer 134 and adjusts an axial position of drive shaft 126 by the tightening or loosening screw member 133.

Figure 2:
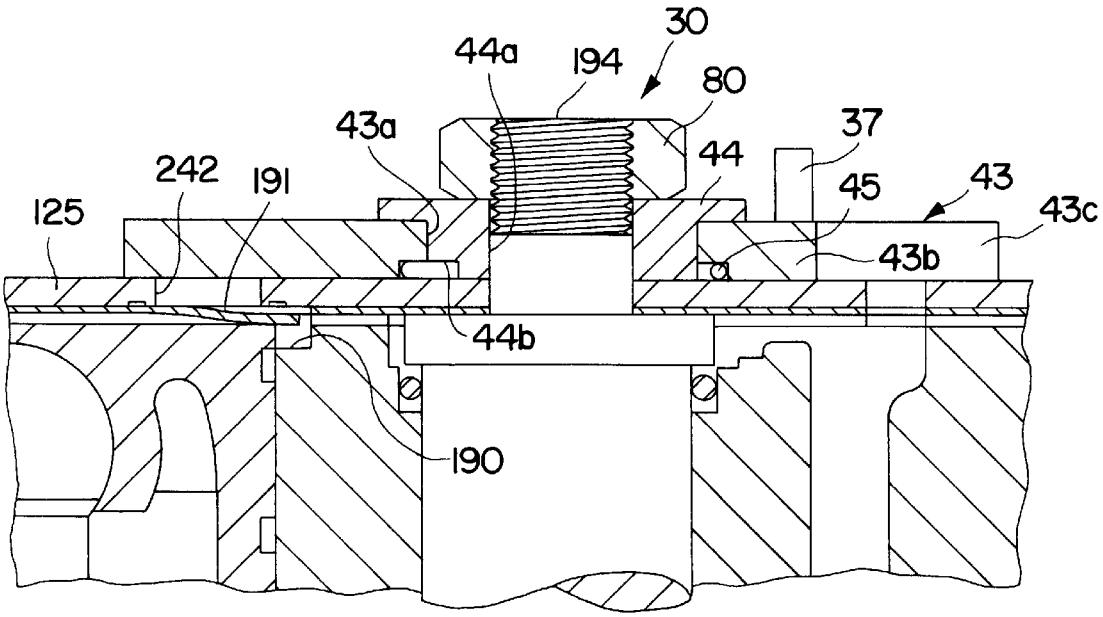
FIG. 2 is an enlarged cross-sectional view of a suction valve assembly in accordance with an embodiment of the present invention.

Connecting rod 172 has first and second ball portions 173*a* and 173*b* formed at the front and rear ends, respectively, of rod 172. Piston 171 is connected to second ball portion 173*b*. Referring to FIG. 2, second gasket 128 includes discharge valve 181 formed therein, which opens and closes discharge conduit 252, and valve retainer 180 formed therein for limiting the movement of discharge valve 181. Referring again to FIG. 2, first gasket 127 also includes suction valve 191 formed therein, which opens and closes suction conduit 242. A groove 190 is formed on a periphery of each cylinder 170 formed at the rear end of cylinder block 121 for restricting the opening motion of suction valve 191.

Referring to FIG. 2, suction valve mechanism 30 comprises a cover plate 43, which may be made of a steel or plastic resin, or the like, that is in contact with a first side surface of valve plate 125 and a supporting plate 44 slidably sandwiching cover plate 43 to valve plate 125. Cover plate 43 and supporting plate 44 have openings 43*a* and 44*a*, respectively, formed at central portions thereof, and are secured with together by coupling device, such as nut 80, so that axial movement of cover plate 43 and supporting plate 44 is limited. Thus, threaded cylindrical member 194 inserts into openings 43*a* and 44*a* of core plate 43 and supporting plate 44.

Figure 3:
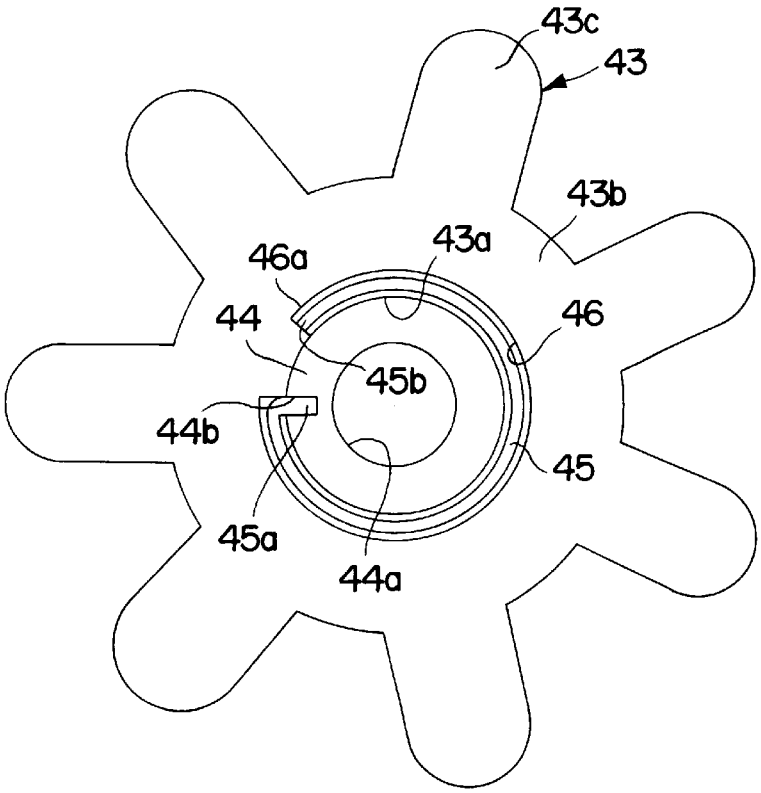
FIG. 3 depicts a cover plate of suction valve assembly in accordance with the present invention.

In addition, referring to FIG. 3, cover plate 43 has a core portion 43*b* formed at the center thereof and a plurality of projections 43*c* corresponding to a number of suction ports 242. A plurality of projections 43*c* are formed radially extending from the circumferential edge of circular shaped core projection 43*b* at equal intervals. Cover plate 43 includes notch portion 46 formed on a first end surface thereof and at least partially surrounding opening 43*a*. Supporting plate 44 includes cavity 44*b* formed therein and opened to notch portion 46. A ring spring 45 has a first end portion 45*a* extending in a radial direction and is disposed within notch portion 46, so that first end portion 45*a* is inserted into cavity 44*b* of supporting plate 44 and other end, portion 45*b* is in contact with an edge wall 46*a* of notch portion 46.

Figure 4:
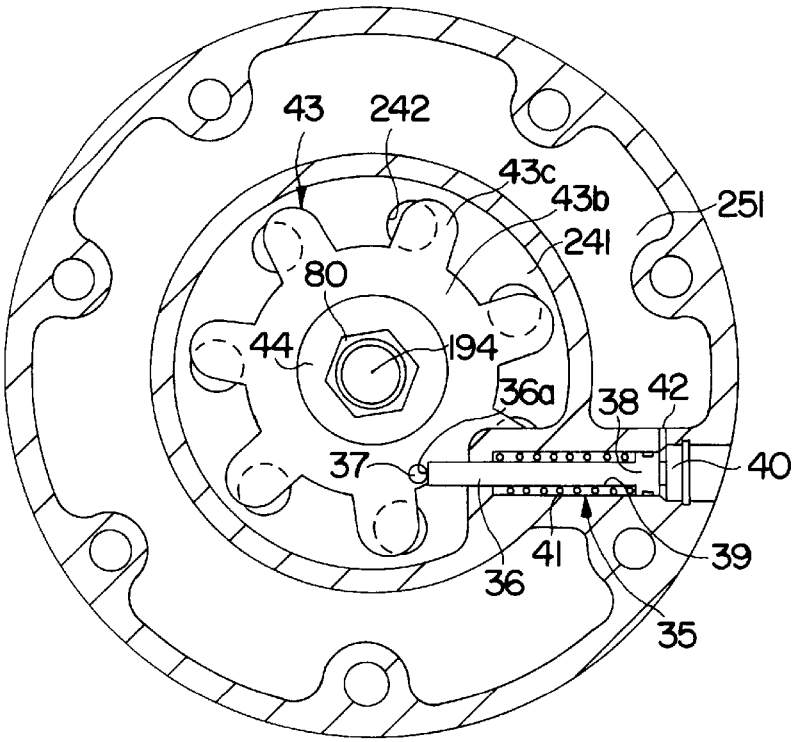
FIG. 4 is a cross-sectional view of FIG. 1 taken along line 4—4 showing a first embodiment of the suction valve assembly stating one situation.

Referring to FIG. 4, cover plate 43 also has a pin portion 37 axially extending from a second end surface thereof. Rear end plate 124 contains a piston mechanism 35. Piston mechanism 35 includes a cylinder 39 oriented substantially perpendicular to the axis of drive shaft 126, a piston 38 disposed within cylinder 39, and a rod 36 extending from piston 38 toward suction chamber 241 and engaging pin portion 37. Piston 38 is preferably capable of reciprocating within cylinder 39. A first end of cylinder 39 is closed by a faucet 40. A coil spring 41 is disposed between a second end of cylinder 39 and piston 38 to urge piston 38 toward faucet 40. Cylinder 39 is in fluid communication with discharge chamber 251 through passage 42 formed therebetween in rear end plate 124.

In operation, drive shaft 126 is rotated by the engine of the vehicle through electromagnetic clutch 300. Cam rotor 140 rotates together with drive shaft 126, thereby rotating slant plate 150, which causes wobble plate 160 to nutate. The nutational motion of wobble plate 160 reciprocates pistons 171 in their respective cylinders 170. As pistons 171 are reciprocated, refrigerant gas is introduced into suction chamber 241 through inlet port 241*a*. The gas then passes to cylinders 170 through suction valve mechanism 30 where it is compressed. The compressed refrigerant gas is discharged to discharge chamber 251 from each cylinder 170 through discharge conduits 252, and therefrom into the cooling circuit (not shown) through outlet port 251*a*.

The operation of suction valve mechanism 30 is now described in greater detail.

When compressor 10 begins to start, the difference between the pressure in discharge chamber 251 and the pressure in suction chamber 241 is small. As depicted in FIG. 4, one end of piston 38 is in contact with faucet 40 because the restoring force of coil 41 has overcome the pressure in cylinder 39. The restoring force of ring spring 45 allows to rotate cover plate 43 to rotate in a counter-clockwise direction. Therefore, cover plate 43 is at the position as shown in FIG. 4, such that a plurality of projections 43*c* cover open ends of suction ports 242, respectively, allowing a predetermined minimum opening, for example, about 10–30 percent of suction port 242 is opened to suction chamber 241. In another embodiment, cover plate 43 may be designed to entirely cover the open ends of suction ports 242.

Figure 5:
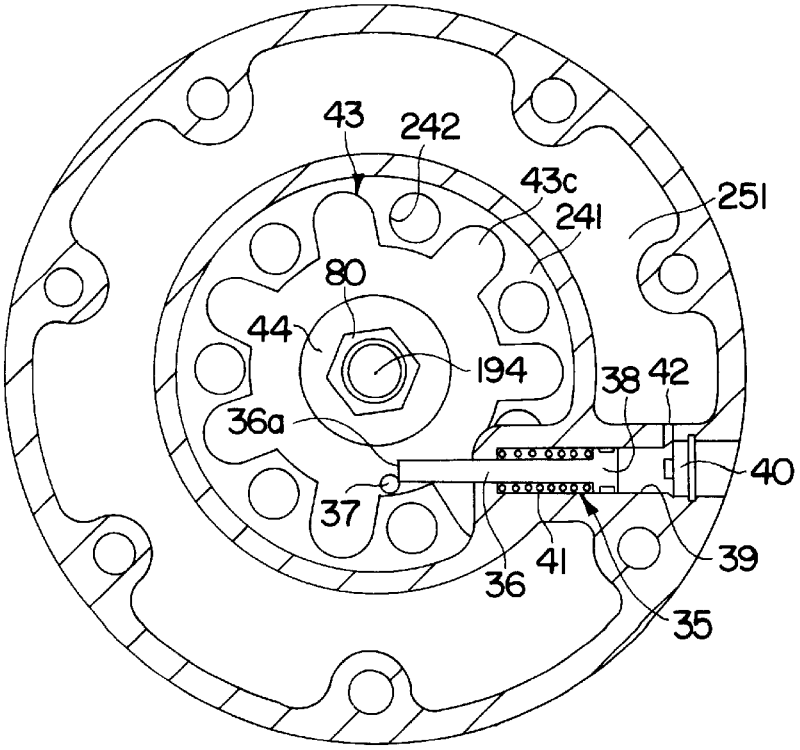
FIG. 5 is a cross-sectional view of FIG. 1 taken along line 4—4 a second embodiment of the suction valve assembly stating other situation.

When compressor 10 shifts to ordinary operation, the pressure in cylinder 39 increases due to an increase in pressure within discharge chamber 251. Thus, a difference occurs between the pressure in cylinder 39 and the pressure in suction chamber 241. Accordingly, piston 38 moves toward suction chamber 241 against the restoring force of coil spring 41, as depicted in FIG. 5. End portion 36*a* of piston rod 36 protrudes from cylinder 39 into suction chamber 241 and engages pin portion 37 to rotate cover plate 43 in an amount equal to an angle θ against the restoring force of ring spring 45. Thereby, each projection 43*c* uncovers one of the open ends of suction ports 242. The area of the open ends of suction ports 242 increases toward a predetermined maximum opening, for example, completely open or uncovered.

Thus, regulaton of the extent, to which the area of the open ends of suction ports 242 is opened or closed is achieved by varying the cross-sectional area of cylinder 39; or the spring constant of springs 41 or 45, or both; the length of piston rod 36; or the location of piston rod 36.

As described above with respect to FIG. 1, the pressure of discharge chamber 251 is relatively low at the time of starting the compressor. At that time, as shown in FIG. 4, projection 43*c* only covers the open ends of suction ports 242 at predetermined minimum opening. A relatively small amount of refrigerant gas is introduced into cylinders 170 through suction conduit 242. Therefore, compressor 10 need not perform excessive compressive work at start-up, and refrigerant gas is gradually discharged to discharge chamber 251 from cylinder 170. As a result, torque shock of the compressor at the time of starting is reduced.

The open ends of suction ports 242 may be entirely opened to suction chamber 241 during ordinary operation of compressor 10. Thereby, fluid resistance of refrigerant gas at suction ports 242 may be reduced, and a relatively large amount of refrigerant gas may be introduced into cylinder 170 through suction port 242. Therefore, the compressor may obtain the high design volumetric efficiency.

Accordingly, the present embodiment reduces the starting torque shock to the compressor while maintaining the high volumetric efficiency of the compressor.

Although the present invention has been described in detail in connection with preferred embodiments, the invention is not limited thereto. It will be understood by those of ordinary skill in the art that variations and modifications may be made within the scope of this invention, as defined by the following claims.

What is claimed is:

1. A refrigerant compressor comprising:

a compressor housing divided by a valve plate into a first chamber and a second chamber, said second chamber comprising a discharge chamber and a suction chamber;

a linking means for linking said first chamber to said second chamber, said linking means including a plurality of discharge conduits placing said first chamber in communication with said discharge chamber, and a plurality of suction conduits placing said first chamber in communication with said suction chamber;

a plurality of suction valve members, each of which is responsive to a difference in pressure between said first chamber and said suction chamber to open and to close a corresponding one of said suction conduits;

a plurality of discharge valve members, each of which is responsive to a difference in pressure between said first chamber and said discharge chamber to open and close a corresponding one of said discharge conduits; and suction conduit regulating means disposed in said suction chamber for regulating an area of an open end of at least one of said suction conduits, said regulating means including a plate member mounted on a drive shaft in said compressor and rotatably movable around a longitudinal axis of said drive shaft, for closing and opening said open end of said suction conduit, wherein said plate member includes a first portion having a circular shape defining a circumferential edge and a plurality of second portions radially extending from said circumferential edge of said first portion for covering corresponding said suction conduits, wherein said regulating means opens said suction conduit toward a maximum opening position in response to an increase of a difference in pressure between said suction chamber and said discharge chamber, and toward a minimum opening position in response to a decrease of said difference in pressure between said suction chamber and said discharge chamber;

wherein said regulating means includes a piston mechanism comprising a piston rod for engaging said plate member to move said plate member, which is responsive to said difference in pressure between said suction chamber and said discharge chamber, and further comprising a spring attached to said piston mechanism to urge said plate member toward a minimum opening position; and wherein said piston is mounted in a cylinder, and wherein one end of said piston is exposed only to a pressure in said discharge chamber and an opposite end of said piston is exposed directly to a pressure in said suction chamber.

2. A suction valve assembly for use in a compressor having a suction chamber and a discharge chamber on one side of a valve plate and a compression chamber on a second side of said valve plate, said assembly comprising:

a plurality of suction conduits disposed in said valve plate for placing said compression chamber in communication with said suction chamber; and suction conduit regulating means disposed in said suction chamber for regulating an area of an open end of at least one of said suction conduits, said regulating means including a plate member mounted on a drive shaft in said compressor and rotatably movable around a longitudinal axis of said drive shaft, for closing and opening said open end of said suction conduit, wherein said plate member includes a first portion having a circular shape defining a circumferential edge and a plurality of second portions radially extending from said circumferential edge of said first portion for covering corresponding said suction conduits, wherein said regulating means opens said suction conduit toward a maximum opening position in response to an increase of a difference in pressure between said suction chamber and said discharge chamber, and toward a minimum opening position in response to a decrease of said difference in pressure between said suction chamber and said discharge chamber;

wherein said regulating means includes a piston mechanism comprising a piston rod for engaging said plate member to move said plate member, which is responsive to said difference in pressure between said suction chamber and said discharge chamber, and further comprising a spring attached to said piston mechanism to urge said plate member toward a minimum opening position; and wherein said piston is mounted in a cylinder, and wherein one end of said piston is exposed only to a pressure in said discharge chamber and an opposite end of said piston is exposed directly to a pressure in said suction chamber.

* * * * *